United States Patent [19]

Epstein

[11] 3,972,136

[45] Aug. 3, 1976

[54] FOOTWEAR CONSTRUCTION

[76] Inventor: William H. Epstein, 1201 NE. 191st St., North Miami Beach, Fla. 33162

[22] Filed: Feb. 28, 1975

[21] Appl. No.: 554,277

[52] U.S. Cl. ..... 36/101

[51] Int. Cl.[2] ..... A43B 3/24

[58] Field of Search ..... 36/45, 2.5 R, 2.5 C, 36/2.5 W, 100, 101

[56] References Cited

UNITED STATES PATENTS

| | | | |
|---|---|---|---|
| 2,068,946 | 1/1937 | Ferguson | 36/2.5 W |
| 2,205,577 | 6/1940 | Roberts | 36/45 |
| 2,444,640 | 7/1948 | Epstein | 36/2.5 C |
| 3,099,884 | 8/1963 | Kixmiller et al. | 36/2.5 W |

FOREIGN PATENTS OR APPLICATIONS

| | | | |
|---|---|---|---|
| 1,535,635 | 6/1967 | France | 36/2.5 W |

*Primary Examiner*—Patrick D. Lawson

*Attorney, Agent, or Firm*—Blum, Moscovitz, Friedman & Kaplan

[57] ABSTRACT

A footwear construction is provided having a vamp portion extending upwardly from the periphery of the forward portion of the sole and a plug bridging the upper periphery of the vamp portion to overlie the toe and instep region of the sole. Either the plug, the vamp portion or a coupling member joining the plug and vamp portion is formed of elastic material. The plug may be releasably securable to the vamp portion by a slide fastener and a decorative plug cover may be releasably secured to the plug to permit the production of selective decorative effects and to obscure the slide fastener from sight, if desired.

15 Claims, 12 Drawing Figures

FIG.1
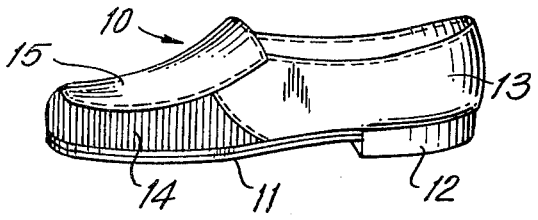
FIG.2
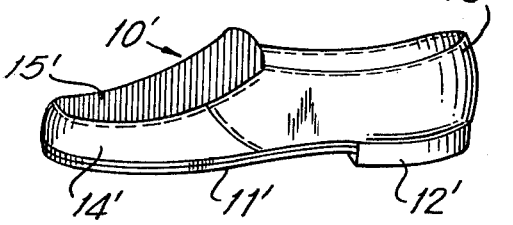
FIG.3
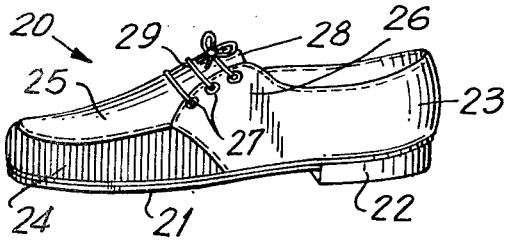
FIG.4
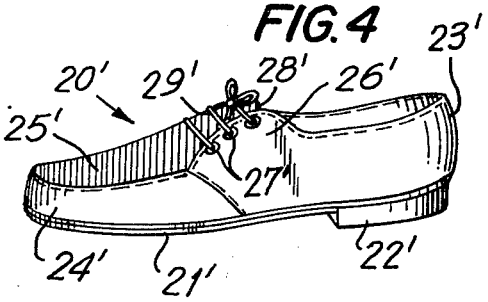
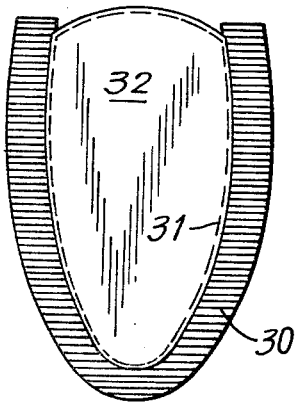
FIG.5
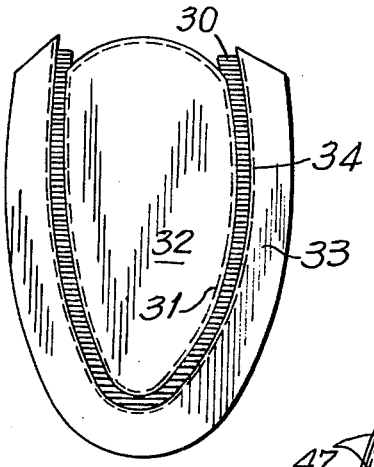
FIG.6
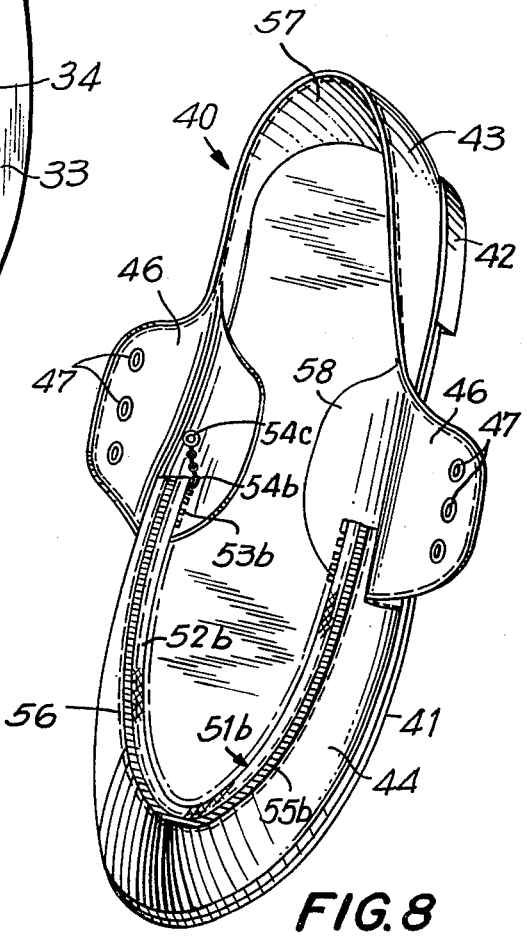
FIG.8
FIG.7
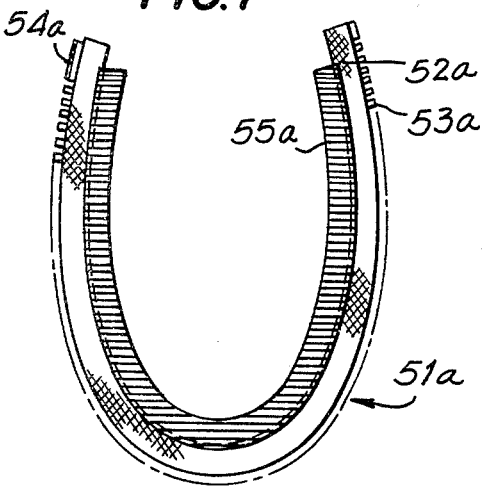

FOOTWEAR CONSTRUCTION

BACKGROUND OF THE INVENTION

Generally speaking, this invention relates to all types of footwear constructions, and in particular, to shoes of the slip-on or blucher moccasin type. In such constructions, the vamp of the footwear constructions, that portion enclosing the toe and instep regions of the wearer's foot, are generally formed in two parts, namely a vamp portion or mudguard extending upwardly from the periphery of the sole in the forward region thereof, so as to surround the instep and toe regions of the wearer's foot and a plug or insert secured to the upper periphery of the vamp portion and bridging same so as to enclose the instep and toe regions of the wearer's foot. As taught in my prior U.S. Pat. No. 2,444,640, issued on July 6, 1948 for BLUCHER TYPE SHOE WITH REMOVABLE PLUG, the plug and vamp portion may be removably secured together, thereby permitting the substitution of the plug so as to produce various decorative effects.

However, one difficulty with the prior art footwear constructions heretofore utilized is that they did not adopt to the varying contours of the wearer's feet, causing irritation and discomfort to sensitive regions of the wearer's feet. A further difficulty with the removable plug embodiments of the known footwear constructions is that the slide fastener was frequently visible, causing an unsightly effect, and further, it was relatively costly to provide each of a plurality of plugs with slide fasteners, thereby limiting the number and variety of decorative effects which could be produced.

By forming at least a portion of either said plug, vamp portion or an element interconnecting same of an elastic material, a substantially more comfortable footwear construction avoiding some of the difficulties with the prior art constructions is produced. By producing a separate plug cover releasably secured to said plug, a more sightly shoe construction may be produced.

SUMMARY OF THE INVENTION

Generally speaking, in accordane with the invention, a footwear construction is provided having a sole portion, a rear quarter extending about the rearward periphery of said sole portion, vamp portion means extending about the forwardly periphery of the sole portion, plug means dimensioned to bridge the upper periphery of said vamp portion means and securing means attaching the periphery of said plug means to the upper periphery of said vamp portion means. At least a portion of at least one of said vamp portion means, plug means and securing means being formed of elastic material, the balance thereof being formed of an inner elastic material, whereby said elastic material imparts elastic stretchability to the forward portion of the footwear construction to provide a foot-conforming fit.

Said securing means may include means for releasably securing said plug means to said vamp portion means, said shoe construction further including plug cover means and means for releasably securing said plug cover means to said plug means. Said plug cover means may be dimensioned to overlie said plug means and said first-mentioned securing means.

Accordingly, it is an object of the invention to produce a footwear construction of particular comfort by providing, in the forwardly portion thereof, elastic regions.

A further object of the invention is to provide a footwear construction having a removable plug wherein decorative plug cover means are provided releasably secured to said plug to enhance the sightliness and decorative effects producable in said footwear constructions.

Still other objects and advantages of the invention will in part be obvious and will in part be apparent from the specification and drawings.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a slip-on type footwear construction in accordance with the invention and having an elastic vamp portion and a non-elastic plug;

FIG. 2 is a perspective view of a further embodiment of a slip-on footwear construction in accordance with the invention having an elastic plug and a non-elastic vamp portion;

FIG. 3 is a perspective view of a blucher laced footwear construction in accordance with the invention having an elastic vamp portion and a non-elastic plug;

FIG. 4 is a perspective view of still another embodiment of a blucher laced footwear construction in accordance with the invention having an elastic plug and an inelastic vamp portion;

FIG. 5 is a top plan view of a plug having an elastic U-shaped securing member attached to the periphery thereof;

FIG. 6 is a fragmentary top plan view of a footwear construction in accordance with the invention depicting the plug and securing member of FIG. 5 affixed to a vamp portion thereof;

FIG. 7 is a plan view of a portion of a coupling member in accordance with the invention defined by one half of a slide fastener and an elastic band;

FIG. 8 is a perspective view of a blucher type footwear construction embodying the invention and illustrating the coupling member portion of FIG. 7 secured to the vamp portion of said footwear construction;

DESCRIPTION OF THE PREFERRED EMBODIMENTS

Figure 9:
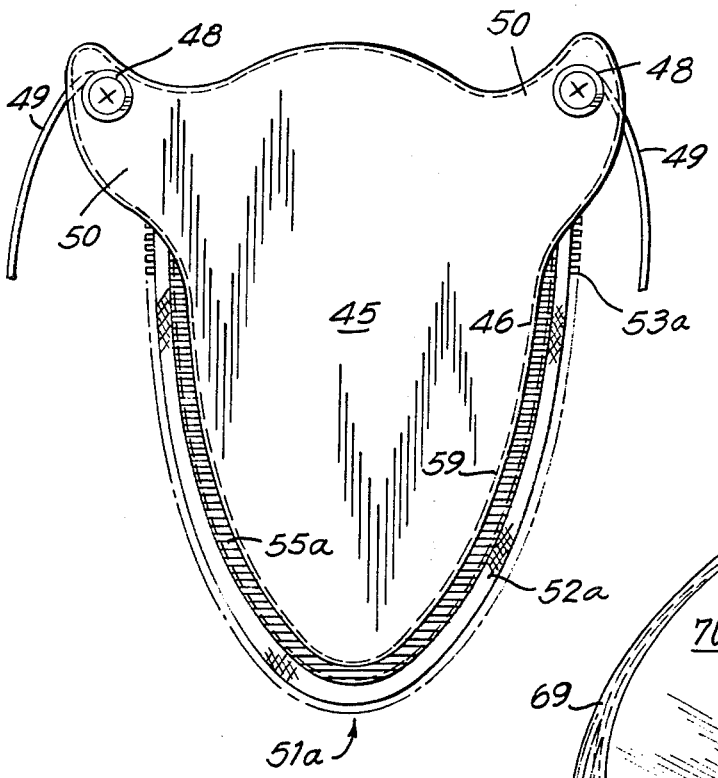
FIG. 9 is a plan view of a plug in accordance with the invention for mating with the footwear construction of FIG. 8.

Referring first to FIG. 1, the slip-on type shoe 10 depicted includes a sole 11, a heel 12 and a counter or rear quarter 13 affixed to the rearwardly periphery of sole 11. A vamp portion 14 extends upwardly from the forwardly periphery of sole 11 and is stitched along its upper periphery to a plug 15 and along its rearward periphery to counter 13. Plug 15 and vamp portion 14 together define the region of the shoe which receives the toe and instep regions of the wearer's foot. In this embodiment of the footwear construction in accordance with the invention, vamp portion 14 is a gore or insert of elastic material so that it will stretch in response to the shape of the wearer's foot and movements thereof, whereas the remaining elements of the shoe are constructed of non-elastic material such as leather, artificial leather, or suitable plastic composition materials. The elasticity of vamp portion 14 provides a conforming fit of the shoe to the foot.

In the embodiment of FIG. 2, slip-on type shoe 10' is formed of the same general construction as shoe 10, except that vamp portion 14' is formed of a non-elastic material while plug 15' is formed of an elastic material, thereby creating the same foot-conforming fit as that produced by the embodiment of FIG. 1. Elastic plug 15' is stitched at its edges to the upper periphery of non-elastic vamp portion 14' and the forwardly upper periphery of the non-elastic counter 13' Shoe 10' is also provided with a conventional sole 11' and heel 12'.

FIGS. 3 and 4 depict blucher oxford moccasin type shoes embodying the arrangement in accordance with the invention. Shoe 20 of FIG. 3 comprises a sole 21, a heel 22 and a rear quarter or counter 23. A vamp 24 formed of an elastic material is secured at its lower periphery to sole 21, at its upper periphery to non-elastic plug 25 and at its rearward periphery to non-elastic counter 23. Plug 25 is formed with a tongue 28 formed integral therewith. Counter 23 is formed with flap portions 26 which, at least in part, overlie tongue 28, and are, in turn, formed with eyelets 27 for receiving a lace 29 or the like. As in the case of shoe 10, the elastic vamp portion 24 provides the foot-conforming fit in accordance with the invention.

Similarly, shoe 20' of FIG. 4 is provided with an elastic plug 25' while vamp portion 24' is formed of a non-elastic material. In other respects, shoe 20' is identical to shoe 20, being provided with sole 21', heel 22', counter 23' formed with flap portions 26' and having eyelets 27' formed therein, tongue portion 28' of plug 25', and lace 29'.

A further embodiment of the footwear construction in accordance with the invention is illustrated in FIGS. 5 and 6. In this embodiment, both plug 32 and vamp portion 33 are formed of non-elastic materials but are joined together by a U-shaped strip 30 formed of elastic material secured to plug 32 by stitching 31 and to vamp portion 33 by stitching 34.

In this embodiment, the foot-conforming fit is provided by the elastic coupling strip 30.

As is taught in my U.S. Pat. No. 2,444,640, plugs of the type herein described may be releasably secured to vamp portions by means of a slide fastener. The foot-conforming elastic feature of the arrangement in accordance with the invention may be incorporated in a footwear construction including such a releasably mounted plug by providing either an elastic plug, an elastic vamp portion, or an elastic coupling therebetween. The latter arrangement is more particularly shown, by way of example, in the embodiment of FIGS. 7–9, wherein a blucher-type shoe 40 is illustrated. Shoe 40 is provided with a sole 41 and a heel 42 of conventional construction. Secured to the rearwardly region of sole 41 is a counter 43 having forwardly projecting flap portions 46 provided with eyelets 47 for receiving laces or the like. A vamp portion 44 formed of a non-elastic material is secured at its lower periphery to the forwardly portion of sole 41 and at its rearward periphery to counter 43. A separate, removable plug 45 (FIG. 9) is provided having flap portions 50 which extend from either side of plug 45 in the rearward region thereof. Each of flap portions 50 are provided with an eyelet (not shown) through which a lace 49 extends. The outer end of lace 49 is secured to a button 48 which serves to secure the lace to plug 45. Each lace 49 is adapted to extend through one of eyelets 47 in flap portion 46 of counter 43 to hold the respective flap portions in position.

Secured to the periphery of plug 45 is a first portion **51*a* of a slide fastener assembly, more particularly depicted in FIG. 7. Slide fastener assembly portion 51*a* includes a conventional slide fastener tape 52*a* having teeth 53*a* projecting therefrom and a pin 54*a* at one end of said line of teeth. Secured to the inner periphery of tape 52*a* is an elastic U-shaped strip 55*a*. Slide fastener assembly portion 51*a* is secured to plug 45 by stitching elastic U-shaped strip 55*a* to said plug by means of stitching 59. A similar slide fastener assembly 51*b* adapted to mate with slide fastener assembly 51*a* is secured to the periphery of vamp portion 44. Specifically, a slide fastener tape 52*b* is provided with teeth 53*b* on its outer periphery for mating with the teeth 53*a* of slide fastener tape 52*a* and is secured at its periphery to an elastic U-shaped strip 55*b*. The slide fastener assembly portion 51*a* also includes a conventional socket element 54*b* for receiving pin 54*a* and a chain pulled slide member 54*c*. Said assembly is secured to the upper periphery of vamp portion 44 by means of stitching 56. Shoe 40 is provided with an inner lining 57 at least in the region of counter 43, which inner lining is provided with inwardly projecting flaps 58. Pin 54*a* and socket 54*b* on one side and slide 54*c* and associated chain on the other side are received between flaps 58 of lining 57 and flap portions 46 of counter 43**. This construction conceals the slider, pin and socket from view and also protects the foot of the wearer from irritation by reason of such bulky metal or plastic elements.

While in the embodiment of FIGS. 7–9, elastic strips are secured to both portions of the slide fastener, in order to provide the foot-conforming feature in accordance with the invention. Only one such U-shaped elastic strip may be provided, the tape of the other slide fastener portion being secured directly to either the plug or vamp portion, as desired.

Figure 10:
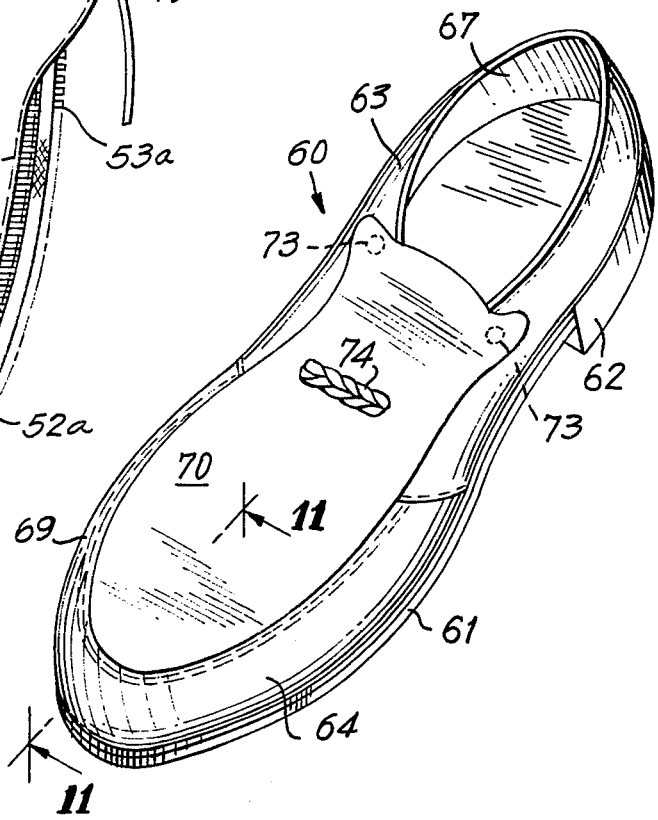
FIG. 10 is a perspective view of still another embodiment of the footwear construction in accordance with the invention.
Figure 11:
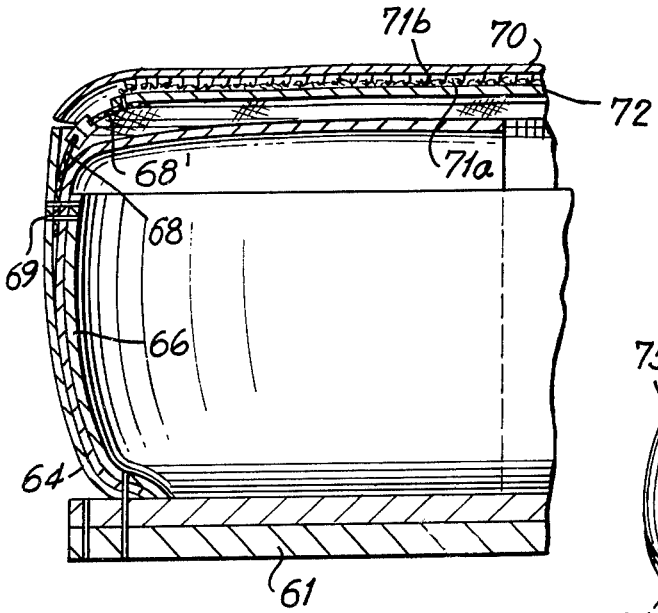
FIG. 11 is a sectional view taken along lines 11—11 of FIG. 10.
Figure 12:
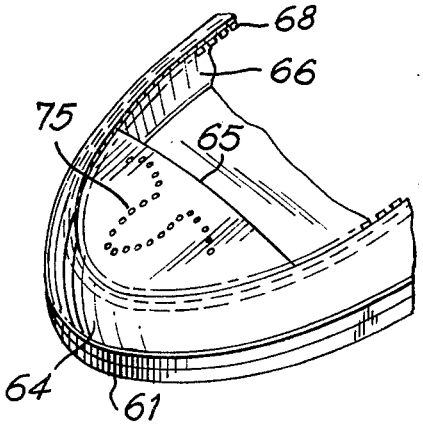
FIG. 12 is a fragmentary top plan view of the footwear construction of FIG. 10 with the plug and plug cover thereof removed.

Referring now to FIGS. 10–12, still another embodiment of the footwear construction in accordance with the invention is depicted. Shoe 60, which is of the blucher-type, is provided with a sole 61 and a heel 62 of conventional construction. A rear quarter or counter 63 is secured to the rearwardly portion of sole 61 and is provided with a lining 67. Lining 67 and counter 63 are similar in construction to lining 57 and counter 43 of shoe 40 of FIG. 8 and are provided with corresponding flap portions. However, in the embodiment of FIG. 10, the eyelets are replaced by one portion of a conventional snap fastener. The vamp portion 64 is secured to sole 61 and extends upwardly therefrom in the forwardly region. Also secured to sole 61 is a toe box 65 (FIGS. 11 and 12) which is provided in the toe region of shoe 60 in order to maintain the shape of the toe region and in order to permit the wearing of shoe 60 as a sandle when the hereinafter described plug is removed, by providing support for the toe region of the foot of the wearer. An inner lining 66 is provided in cooperation with vamp portion 64 as more particularly shown in FIG. 11. A first slide fastener portion 68 formed of an elastic tape having teeth extending from one side edge thereof is secured by means of stitching 69 to vamp portion 64. In the embodiment of FIGS. 10–12, the upper edge of the teeth of first slide fastener portion 68 extend to a height equal to or slightly below the upper periphery of vamp portion 64 so as to minimize the visibility thereof, thereby enhancing the sightliness of the shoe. A plug 72 (FIG. 11) is provided having a second slide fastener portion 68' adapted for mating with said first slide fastener portion 68 secured to the periphery thereof. In the embodiment of FIGS. 10–12, the tape portions of slide fastener portions 68 and 68' are formed of an elastic material to provide the foot-conforming feature in accordance with the invention, thereby avoiding the necessary of a separate elastic strip. Shoe 60 is also provided with a decorative plug cover 70 which is secured to plug 72 by any releasably securing means, a VELCRO securing means being depicted in FIG. 11 by way of example. Said VELCRO securing means includes a loop assembly 71*a* secured to the top surface of plug 72 and a hook assembly 71*b* secured to the bottom surface of plug cover 70 for mating in a well known manner. As shown in FIGS. 10 and 11, plug cover 70 is preferably dimensioned to extend beyond the periphery of plug 72 so as to shield from view slide fastener portions 68 and 69. A number of different plug covers 70 may be provided, each of a different color, different material or providing a different decorative effect, as desired, thereby enhancing the sightliness of shoe 60 and the flexibility thereof.

Plug 72 would be provided with the mating portion of the snap fastener 73 (FIG. 10) described above in connection with counter 63.

Exemplary of the ornamental effects which may be produced is the decorative strap 74 depicted on plug cover 70 (FIG. 10) and the ornamental markings 75 on the top surface of the toe box 65.

The releasably secured plug cover 70 can be utilized with any footwear construction and is not limited in its application to footwear constructions including the elastic vamp portion, plug or connecting elements therebetween in accordance with the invention, nor to footwear constructions having removable plugs, or even separate plugs. Thus, where a unitary vamp is provided, a plug cover can be releasably secured to the top surface of such vamp.

The footwear construction in accordance with the invention provides both comfortable and sightly products and permit a great deal of flexibility on the part of both the manufacturer and user. Thus, plugs of different colors or different designs may be readily and interchangeably secured to the shoes whereby a variety of style and color effects are easily attained. The elastic material may be distinctly colored so as to either contrast or melt into the color of the remaining portions of the shoe, thereby producing a variety of visual effects.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A footwear construction comprising a sole portion, a counter portion extending substantially upwardly from the rearwardly peripheral region of said sole portion; vamp portion means extending substantially upwardly from the forwardly peripheral region of said sole portion; plug means dimensioned to substantially bridge the upper periphery of said vamp portion means and means for releasably securing together the periphery of said plug means to the upper periphery of said vamp portion means, said releasable securing means including first and second slide fastener teeth means for releasable interengagement, first means securing said first slide fastener teeth means to said plug means and second means securing said second slide fastener teeth means to said vamp means, at least one of said first and second securing means including at least a region formed of an elastic material, whereby said elastic material imparts elastic stretchability to the forward portion of the footwear construction to provide a foot-conforming fit.

2. A footwear construction as recited in claim 1, wherein said plug means is formed of an elastic material, said vamp portion means being formed of an inelastic material.

3. A shoe construction as recited in claim 1, wherein said vamp portion means is formed of an elastic material, said plug means being formed of a substantially inelastic material.

4. A footwear construction as recited in claim 1, wherein said footwear construction is a slip-on type shoe.

5. A footwear construction as recited in claim 1, wherein said footwear construction is a blucher-type shoe.

6. A footwear construction as recited in claim 1, wherein each of the first and second means securing one of said first and second slide fastener teeth means to one of said plug means and vamp portion means includes a tape means secured to the respective teeth means and supporting said teeth means, and at least one strip of elastic material intermediate at least a portion of the tape means of at least one of said first and second securing means and the associated one of said plug means and vamp portion means.

7. A footwear construction as recited in claim 1, wherein at least one of said first and second securing means for said first and second slide fastener teeth means includes tape means secured to the respective teeth means and supporting said teeth means, at least a portion of one of said tape means being formed from elastic material.

8. A footwear construction as recited in claim 1, including lining means within said counter portion formed with flaps for positioning below the ends of said slide fastener teeth means, said counter portion being formed with flaps projecting therefrom for overlying the ends of said slide fastener teeth means whereby said ends are shielded from view and from the foot of the wearer of said footwear construction by the respective flaps.

9. A footwear construction as recited in claim 1, including plug cover means and means for releasably securing said plug cover means to said plug means, whereby a plurality of decorative effects may be created by selective substitution of said plug cover means.

10. A footwear construction as recited in claim 9, wherein said plug cover means is dimensioned to overlie said securing means to shield same from view.

11. A footwear construction as recited in claim 10, wherein said means releasably securing said plug cover means to said plug means is Velcro.

12. A moccasin slip-on type footwear construction comprising a sole portion; a counter portion extending upwardly from the rearwardly peripheral region of said sole portion; exposed vamp portion means extending upwardly from the forwardly peripheral region of said sole portion; separate plug means dimensioned to substantially bridge the upper periphery of said vamp portion means and overlie the forwardly region of said sole portion; means for securing said plug means to said vamp portion means; plug cover means and hook and loop fastener means releasably securing said plug cover means to the upper surface of said plug means, said plug cover means being dimensioned to overlie the hook and loop fastener means between said plug cover means and plug to shield same from view, whereby a plurality of said plug cover means may be provided to produce a plurality of ornamental effects.

13. A shoe construction as recited in claim 12, wherein said means securing said plug means and vamp portion means is a releasable securing means, said plug cover means being dimensioned to overlie said releasable securing means between said plug means and vamp portion means to shield same from view.

14. A footwear construction as recited in claim 6, wherein said at least one strip of elastic material is substantially U-shaped and joins one of said tape of said first and second securing means and the associated one of said plug means and vamp portion means.

15. A footwear construction as recited in claim 7, wherein substantially all of at least one of said tape means is formed of said elastic material.

* * * * *